US009654859B2

(12) United States Patent
Chen

(10) Patent No.: US 9,654,859 B2
(45) Date of Patent: May 16, 2017

(54) MOBILE TERMINAL EARPHONE LINE CONTROL CIRCUIT AND LINE CONTROL METHOD

(71) Applicant: GUANG DONG OPPO MOBILE TELECOMMUNICATIONS CORP., LTD, Chang'an Dongguan, Guangdong (CN)

(72) Inventor: Biao Chen, Guangdong (CN)

(73) Assignee: GUANGDONG OPPO MOBILE TELECOMMUNICATIONS CORP., LTD., Guandong (CN)

( * ) Notice: Subject to any disclaimer, the term of this patent is extended or adjusted under 35 U.S.C. 154(b) by 0 days.

(21) Appl. No.: 14/889,268

(22) PCT Filed: May 5, 2014

(86) PCT No.: PCT/CN2014/076751

§ 371 (c)(1),
(2) Date: Nov. 5, 2015

(87) PCT Pub. No.: WO2014/180287

PCT Pub. Date: Nov. 13, 2014

(65) Prior Publication Data

US 2016/0080854 A1 Mar. 17, 2016

(30) Foreign Application Priority Data

May 8, 2013 (CN) ..... 2013 1 0167187

(51) Int. Cl.
*H04R 1/10* (2006.01)
*H04R 3/00* (2006.01)

(52) U.S. Cl.
CPC ..... *H04R 1/1041* (2013.01); *H04R 3/00* (2013.01)

(58) Field of Classification Search
CPC ..... H04R 1/1041; H04R 3/00
See application file for complete search history.

(56) References Cited

U.S. PATENT DOCUMENTS 7,983,722 B2 * 7/2011 Lowles ..... H04M 1/6058 455/41.2
8,548,538 B2 * 10/2013 Lowles ..... H04M 1/6058 381/309

(Continued)

FOREIGN PATENT DOCUMENTS

CN 2653799 Y 11/2004
CN 101216731 A 7/2008

(Continued)

*Primary Examiner* — Sonia Gay
(74) *Attorney, Agent, or Firm* — Young Basile Hanlon & MacFarlane, P.C.

(57) ABSTRACT

An earphone wire control circuit and wire control method for a mobile terminal. The wire control circuit includes a circuit in the earphone and a circuit in the mobile terminal which are coupled via a signal wire. The circuit in the earphone includes a micro controller unit and an attenuation and microphone circuit coupled to the micro controller unit of the earphone. The circuit in the mobile terminal includes an audio analog input channel and an amplifier which are coupled in parallel. The amplifier is coupled to a micro controller unit of the mobile terminal via a wire. The micro controller unit of the mobile terminal is coupled to a central processing unit of the mobile terminal via a wire. The micro controller unit of the earphone includes a button detection module and a pulse-width modulation module.

16 Claims, 2 Drawing Sheets

(56) References Cited

U.S. PATENT DOCUMENTS

| | | | | |
|---|---|---|---|---|
| 8,812,064 | B2 * | 8/2014 | Lowles | H04M 1/6058 381/309 |
| 2004/0203697 | A1 * | 10/2004 | Finn | G08C 17/02 455/420 |
| 2008/0242378 | A1 * | 10/2008 | Lowles | H04M 1/6058 455/575.2 |
| 2010/0266144 | A1 * | 10/2010 | Chiu | H03G 3/34 381/106 |
| 2011/0110514 | A1 * | 5/2011 | Gustavsson | H04M 1/6058 379/430 |
| 2011/0263303 | A1 * | 10/2011 | Lowles | H04M 1/6058 455/575.2 |
| 2014/0031094 | A1 * | 1/2014 | Lowles | H04M 1/6058 455/575.2 |

FOREIGN PATENT DOCUMENTS

| | | | |
|---|---|---|---|
| CN | 101783990 | A | 7/2010 |
| CN | 101986668 | A | 3/2011 |
| CN | 202600109 | U | 12/2012 |
| CN | 103237281 | A | 8/2013 |
| KR | 20070022442 | A | 2/2007 |

* cited by examiner

MOBILE TERMINAL EARPHONE LINE CONTROL CIRCUIT AND LINE CONTROL METHOD

CROSS REFERENCE TO RELATED APPLICATION

The present application is a U.S. national stage of international patent application PCT/CN2014/076751, which claims priority to Chinese Patent Application No. 201310167187.X filed in the Chinese Patent Office on May 8, 2013, the contents of which are incorporated herein by reference in their entirety.

FIELD OF THE TECHNICAL

The present disclosure relates to an earphone wire control circuit and a wire control method for a mobile terminal, such as a mobile phone or a tablet computer.

BACKGROUND

In daily life, people often enjoy music in leisure time to pacify themselves and lower pressure. People often use a mobile terminal (e.g., a mobile phone, a MP3 player) to play music. As mobile phones are carried around in most time, mobile phones are used mostly and widely. When a user directly uses a mobile phone to play music, others may be disturbed if the music is so loud, especially during a lunch break time at the office or in a room having many people therein. At this point, users may couple an earphone with the mobile phone to listen to music by the earphone, so that others may not be disturbed. For convenience, nowadays many earphones are designed to be wire control type, through which users can directly adjust volume of the music, fast forward the music, or skip to next song, and also can switch on or switch off the play function of the mobile terminal.

Presently, most wire control earphones employ a resistor divider to detect buttons. When a microphone of the wire control earphone is being used in a call, if a button is pressed to adjust volume, bias voltage of the microphone will change, which results in harsh POP noise, thereby affecting quality of the call.

SUMMARY

The present invention provides an earphone wire control circuit and a wire control method for a mobile terminal to solve the above technical problem. In the present invention, sending button information by sending different pulse-width modulation (PWM) signals with different frequencies is used to avoid POP noise generated in a call, which improves quality of the call.

To solve the technical problem, the present invention provides an earphone wire control circuit for a mobile terminal. The earphone wire control circuit includes a circuit in an earphone and a circuit in the mobile terminal which are coupled via a signal wire. The circuit in the earphone includes a micro controller unit and an attenuation and microphone circuit coupled to the micro controller unit of the earphone. The circuit in the mobile terminal includes an audio analog input channel and an amplifier which are coupled in parallel. The amplifier is coupled to a micro controller unit of the mobile terminal via a wire. The micro controller unit of the mobile terminal is coupled to a central processing unit of the mobile terminal via a wire. The micro controller unit of the earphone includes a button detection module and a pulse-width modulation module therein. The micro controller unit of the mobile terminal includes a pulse-width modulation signal detection and recognition module and a central processing unit communication interface module.

The attenuation and microphone circuit includes a resistor R1, a resistor R2, a resistor R3, a capacitor C1, a capacitor C2, a capacitor C3, and a microphone. The resistor R1, the capacitor C1, the resistor R2, the resistor R3, and the capacitor C2 are coupled in series and sequentially. The capacitor C2 is grounded. One end of the microphone is coupled to an input end of the resistor R3, and the other end of the capacitor is grounded. One end of the capacitor C3 is coupled to an input end of the resistor R3, and the other end of the capacitor C3 is coupled to the microphone.

The audio analog input channel includes an analog to digital converter module. A resistor R4 is coupled to an input end of the analog to digital converter module in parallel.

The pulse-width modulation module may transmit pulse-width modulation signals with frequencies ranging from 100 KHz to 300 KHz.

The present invention further provides an earphone wire control method for a mobile terminal. The method includes the following.

A pulse-width modulation module sending a corresponding pulse-width modulation signal when a micro controller unit of an earphone detects that a button is pressed.

An attenuation and microphone circuit attenuating the pulse-width modulation signal to make the voltage amplitude be below 100 mV, and adding the attenuated signal to a voice signal generated by a microphone, and then transmitting the added signal to an audio analog input channel and an amplifier.

Recovering a voice signal below 20 KHz in the audio analog input channel and outputting the recovered voice signal, and the amplifier amplifying the pulse-width modulation signal having a frequency above 100 KHz and transmitting the amplified pulse-width modulation signal to a micro controller unit of the mobile terminal.

A micro controller unit of the mobile terminal detecting and recognizing the frequency of the pulse-width modulation signal and determining a pressed button according to the frequency of the pulse-width modulation signal, and a central processing unit of the mobile terminal executing a corresponding function according to the corresponding pressed button.

The frequencies of the pulse-width modulation signals sent by the pulse-width modulation module rang from 100 KHz to 300 KHz.

Detecting press of a button includes that when one button is pressed, a pulse-width modulation signal is sent, and when the same button is released, a pulse-width modulation signal having a different frequency is sent, and when different buttons are pressed, different PWM signals having different frequencies are sent, and when pressed buttons are released, PWM signals having a same frequency are sent.

In the present invention, button information are sent by sending different pulse-width modulation signals with different frequencies, to solve the problem of that the other will hear POP noise generated by pressing a button in a call when a TRRS wire control earphone which uses a potentiometric bias circuit to detect buttons is used, thereby improving call quality and user's experience. Additionally, for the reason of precision of the AD converter and prevention of error detection when a TRRS wire control earphone which uses a potentiometric bias circuit to detect buttons is used, the wire control earphone only has less than ten buttons, however, in the technical solution of the present invention, the number of the buttons can be more than ten buttons.

DETAILED DESCRIPTION OF ILLUSTRATED EMBODIMENTS

To facilitate those skilled in the art to understand the present invention, the present disclosure will be further described in detail below in combination with the accompanying drawings.

Figure 1:
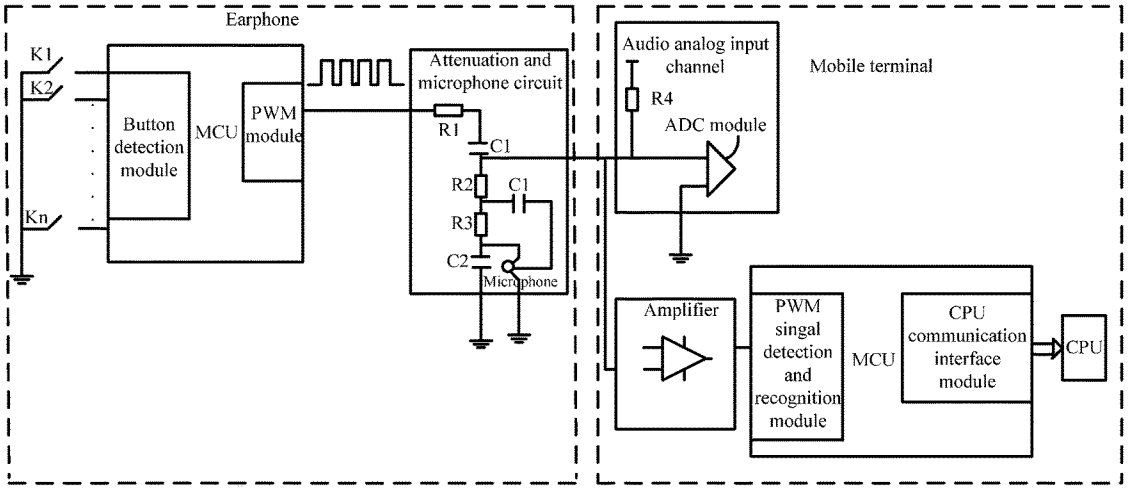
FIG. 1 is a schematic view of a circuit of the present invention.
Figure 2:
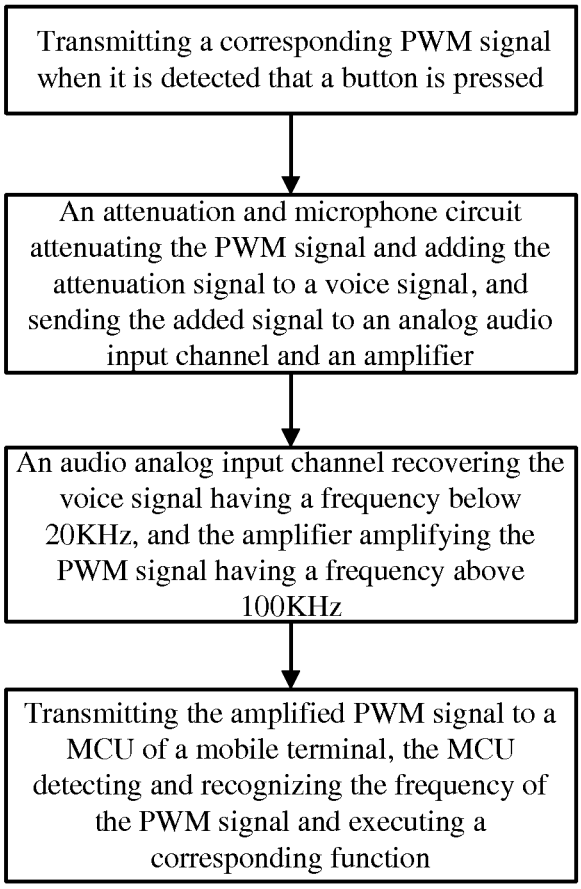
FIG. 2 is a flow chart showing a principle of the present invention.

As shown in FIG. 1, an earphone wire control circuit for a mobile terminal is provided. An earphone wire control circuit for a mobile terminal includes a circuit in the earphone and a circuit in the mobile terminal which are coupled via a signal wire. The circuit in the earphone includes a micro controller unit (MCU) and an attenuation and microphone circuit coupled to the MCU of the earphone. The circuit in the mobile terminal includes an audio analog input channel and an amplifier which are coupled in parallel. The amplifier is coupled to a MCU of the mobile terminal via a wire. The MCU of the mobile terminal is coupled to a central processing unit (CPU) of the mobile terminal via a wire. The MCU of the earphone includes a button detection module and a pulse-width modulation (PWM) module. The MCU of the mobile terminal includes a PWM signal detection and recognition module and a CPU communication interface module. The button detection module of the MCU of the earphone is coupled to corresponding buttons. The number of the buttons can be set flexibly. The button detection module is used to detect whether or not one button is pressed. The PWM module is used to transmit PWM signals, especially the PWM signals having frequencies ranging from 100 KHz to 300 KHz. The amplifier is a typical amplifier and used to amplify the PWM signal having a frequency above 100 KHz.

Additionally, the attenuation and microphone circuit includes a resistor R1, a resistor R2, a resistor R3, a capacitor C1, a capacitor C2, a capacitor C3, and a microphone. The resistor R1, the capacitor C1, the resistor R2, the resistor R3, and the capacitor C2 are coupled in series and sequentially. The capacitor C2 is grounded. One end of the microphone is coupled to an input end of the resistor R3, and the other end is grounded. One end of the capacitor C3 is coupled to an input end of the resistor R3, and the other end is coupled to the microphone. The attenuation and microphone circuit can effectively attenuate the PWM signal, and can attenuate the PWM signal to make the voltage amplitude be below 100 mV. The attenuation PWM signal is then added to a voice signal generated by the microphone, and then the added signal is sent to the mobile terminal via a signal wire.

Additionally, the analog audio input channel includes an analog to digital (ADC) converter module. A resistor R4 is coupled to an input end of the ADC module in parallel. The analog audio input channel can filter the PWM signal having a frequency below 20 KHz, convert analog signal into digital signal, and recover the voice signal and output the recovered voice signal.

The present invention further provides an earphone wire control method for a mobile terminal. The method includes the following steps.

In step S1, the PWM module transmitting a corresponding PWM signal when the MCU of the earphone detects that a button is pressed. The button detection module of the MCU of the earphone detects whether or not a button is pressed in real time. The PWM module transmits a corresponding PWM signal according to press and release of a button. Detecting press of a button includes the following. When a button is pressed, a PWM signal is sent, and when the same button is released, a PWM signal having a different frequency is sent. Furthermore, when different buttons are pressed, different PWM signals having different frequencies are sent. When different buttons are released, PWM signals having a same frequency are sent. The frequencies of the PWM signals sent by the PWM module range from 100 KHz to 300 KHz, and the voltages of the initial PWM signals sent by the PWM module range from 1.7V to 2.5V.

In this embodiment, as shown in FIG. 1, when the button K1 is pressed, a corresponding signal which frequency is F1 is sent. When the button K2 is pressed, a corresponding signal which frequency is F2 is sent. F1 is different from F2. When the pressed button K1 is released, a corresponding signal which frequency is F0 is sent. When the pressed button K2 is released, a corresponding signal which frequency is F0 is sent. F0 is different from F1, and F0 is also different from F2. And so on, when different buttons are pressed, different PWM signals having different frequencies are sent, and when different buttons are released, PWM signals having a same frequency are sent.

In step S2, the attenuation and microphone circuit attenuating the PWM signal to make the voltage amplitude be below 100 mV, adding the attenuated signal to a voice signal generated by the microphone, and transmitting the added signal to the analog audio input channel and the amplifier. That is, the attenuation and microphone circuit attenuates the PWM signal having a voltage amplitude falling within a range from 1.7V to 2.5V to make the voltage amplitude be below 100 mV, and then adds the attenuated signal to the voice signal generated by the microphone. A portion of the added signal is amplified by the amplifier to make the voltage amplitude reach or approximate to a power voltage of the MCU of the mobile terminal.

In step S3, recovering the voice signal below 20 KHz in the analog audio input channel and outputting the recovered voice signal, and the amplifier amplifying the PWM signal having a frequency above 100 KHz and transmitting the amplified PWM signal to the MCU of the mobile terminal.

In step S4, the MCU of the mobile terminal detecting and recognizing the frequency of the PWM signal and determining a pressed button according to the frequency of the PWM signal, and the CPU of the mobile terminal executing a corresponding function according to the corresponding pressed button. The PWM signal detection and recognition module of the mobile terminal detects and recognizes the PWM signal to determine the frequency of the PWM signal, thereby determining which button is pressed. The CPU obtains the button status via the CPU communication interface module (I2C interface or typical IO interface interrupt). Finally, the CPU executes the corresponding function to realize that the mobile terminal can be controlled by the wire control earphone.

What is claimed is:

1. An earphone wire control circuit for a mobile terminal, comprising:

a circuit in an earphone comprising a micro controller unit and an attenuation and microphone circuit coupled to the micro controller unit of the earphone, wherein the micro controller unit of the earphone comprises a button detection module and a pulse-width modulation module; and a circuit in the mobile terminal coupled to the circuit in the earphone via a signal wire and comprising an audio analog input channel and an amplifier which are coupled in parallel, wherein the amplifier is coupled to a micro controller unit of the mobile terminal via a wire, the micro controller unit of the mobile terminal is coupled to a central processing unit of the mobile terminal via a wire, the micro controller unit of the mobile terminal comprises a pulse-width modulation signal detection and recognition module and a central processing unit communication interface module.

2. The earphone wire control circuit for a mobile terminal of claim 1, wherein the attenuation and microphone circuit comprises a resistor R1, a resistor R2, a resistor R3, a capacitor C1, a capacitor C2, a capacitor C3, and a microphone, the resistor R1, the capacitor C1, the resistor R2, the resistor R3, and the capacitor C2 are coupled in series and sequentially, the capacitor C2 is grounded, one end of the microphone is coupled to an input end of the resistor R3, and the other end of the microphone is grounded, one end of the capacitor C3 is coupled to an input end of the resistor R3, and the other end of the capacitor C3 is coupled to the microphone.

3. The earphone wire control circuit for a mobile terminal of claim 2, wherein the audio analog input channel comprises an analog to digital converter module, and a resistor R4 is coupled to an input end of the analog to digital converter module in parallel.

4. An earphone wire control method based on an earphone wire control circuit for a mobile terminal, the earphone wire control method comprising:

transmitting a corresponding pulse-width modulation signal by an earphone when the earphone detects press of a button;

attenuating the corresponding pulse-width modulation signal to make a voltage amplitude of the corresponding pulse-width modulation signal be below 100 mV, adding the attenuation signal to a voice signal generated by a microphone, and transmitting the added signal to the mobile phone;

recovering a voice signal below 20 KHz in the audio analog input channel and outputting the recovered voice signal, and amplifying the pulse-width modulation signal having a frequency above 100 KHz; and detecting and recognizing a frequency of the amplified pulse-width modulation signal and determining press of a button according to the frequency of the amplified pulse-width modulation signal, and executing a corresponding function according to the pressed button by the mobile terminal.

5. The earphone wire control method of claim 4, wherein a frequency of the corresponding pulse-width modulation signal is selected from a range of 100 KHz to 300 KHz.

6. The earphone wire control circuit for a mobile terminal of claim 1, wherein the pulse width modulation module transmits a corresponding pulse width modulation signal when the micro control unit of the earphone detects press of a button; the attenuation and microphone circuit attenuates the corresponding pulse width modulation signal to make a voltage amplitude of the corresponding pulse width modulation signal be below 100 mV, adds the attenuation signal to a voice signal generated by a microphone, and transmits the added signal to the audio analog input channel and the amplifier; the amplifier amplifies a pulse width modulation signal which frequency is above 100 KHz and transmits the amplified pulse width modulation signal to the micro control unit of the mobile terminal; the micro control unit of the mobile terminal detects and recognizes a frequency of the pulse width modulation signal and determines press of a button according to the frequency of the pulse width modulation signal; and the central processing unit of the mobile terminal executes a corresponding function according to the pressed button.

7. The earphone wire control circuit for a mobile terminal of claim 6, wherein a frequency of the corresponding pulse-width modulation signal is selected from a range of 100 KHz to 300 KHz.

8. The earphone wire control circuit for a mobile terminal of claim 6, wherein a voltage of the corresponding pulse-width modulation signal is selected from a range of 1.7V to 2.5V.

9. The earphone wire control circuit for a mobile terminal of claim 6, wherein the button detection module of the micro control unit of the earphone detects press of a button in real time; and the pulse-width modulation module transmits a corresponding pulse width modulation signal according to press and release of a button.

10. An earphone wire control circuit for a mobile terminal, comprising:

a circuit in an earphone comprising a micro controller unit and an attenuation and microphone circuit coupled to the micro controller unit of the earphone, wherein the micro controller unit of the earphone comprises a button detection module coupled to buttons of the earphone and a pulse-width modulation module; and a circuit in the mobile terminal coupled to the circuit in the earphone and comprising an audio analog input channel and an amplifier which are coupled in parallel, wherein the amplifier is coupled to a micro controller unit of the mobile terminal, the micro controller unit of the mobile terminal is coupled to a central processing unit of the mobile terminal, the micro controller unit of the mobile terminal comprises a pulse-width modulation signal detection and recognition module and a central processing unit communication interface module.

11. The earphone wire control circuit for a mobile terminal of claim 10, wherein the attenuation and microphone circuit comprises a resistor R1, a resistor R2, a resistor R3, a capacitor C1, a capacitor C2, a capacitor C3, and a microphone, the resistor R1, the capacitor C1, the resistor R2, the resistor R3, and the capacitor C2 are coupled in series and sequentially, the capacitor C2 is grounded, one end of the microphone is coupled to an input end of the resistor R3, and the other end of the microphone is grounded, one end of the capacitor C3 is coupled to an input end of the resistor R3, and the other end of the capacitor C3 is coupled to the microphone.

12. The earphone wire control circuit for a mobile terminal of claim 11, wherein the audio analog input channel comprises an analog to digital converter module, and a resistor R4 is coupled to an input end of the analog to digital converter module in parallel.

13. The earphone wire control circuit for a mobile terminal of claim 10, wherein the pulse width modulation module transmits a corresponding pulse width modulation signal when the micro control unit of the earphone detects press of one of the buttons; the attenuation and microphone circuit attenuates the corresponding pulse width modulation signal to make a voltage amplitude of the corresponding pulse width modulation signal be below 100 mV, adds the attenuation signal to a voice signal generated by a microphone, and transmits the added signal to the audio analog input channel and the amplifier; the amplifier amplifies a pulse width modulation signal which frequency is above 100 KHz and transmits the amplified pulse width modulation signal to the micro control unit of the mobile terminal; the micro control unit of the mobile terminal detects and recognizes a frequency of the pulse width modulation signal and determines press of one of the buttons according to the frequency of the pulse width modulation signal; and the central processing unit of the mobile terminal executes a corresponding function according to the pressed button.

14. The earphone wire control circuit for a mobile terminal of claim 13, wherein a frequency of the corresponding pulse-width modulation signal is selected from a range of 100 KHz to 300 KHz.

15. The earphone wire control circuit for a mobile terminal of claim 13, wherein a voltage of the corresponding pulse-width modulation signal is selected from a range of 1.7V to 2.5V.

16. The earphone wire control circuit for a mobile terminal of claim 10, wherein the button detection module of the micro control unit of the earphone detects press of one of the buttons in real time; and the pulse-width modulation module transmits a corresponding pulse width modulation signal according to press and release of one of the buttons.

* * * * *